United States Patent [19]

Zieminski

[11] 3,994,331

[45] Nov. 30, 1976

[54] CLOSET PARTITION — INSTANT CLOSET

[75] Inventor: Dennis J. Zieminski, North Fort Meyers, Fla.

[73] Assignee: The Raymond Lee Organization, Inc., a part interest

[22] Filed: Oct. 21, 1975

[21] Appl. No.: 624,490

[52] U.S. Cl. ..... 160/351; 160/118

[51] Int. Cl.[2] ..... A47G 5/00

[58] Field of Search ..... 160/351, 130, 135, 196, 160/199, 200, 206, 118; 49/70; 312/238; 211/95, 115; 52/29

[56] References Cited

UNITED STATES PATENTS

| | | | |
|---|---|---|---|
| 2,855,037 | 10/1958 | Stiffel | 160/135 |
| 2,897,514 | 8/1959 | Collins | 160/196 X |
| 2,943,675 | 7/1960 | Ford | 160/206 |
| 2,944,863 | 7/1960 | Bertelsen | 312/238 |
| 3,351,403 | 11/1967 | Magnuson | 312/238 X |

FOREIGN PATENTS OR APPLICATIONS

| | | | |
|---|---|---|---|
| 11,819 | 1/1896 | Switzerland | 312/238 |

*Primary Examiner*—Philip C. Kannan

[57] ABSTRACT

Each of two like opposed folding panels doors has a plurality of vertically elongated panels. These panels have hingedly secured to each other in side-to-side relationship. The doors slide between an elongated upper track and a like elongated lower track, with one panel in each door being fixed at each end to a corresponding track, to keep the tracks properly aligned. A semi-circular hanger plate is pivotally secured to the upper track to be rotatable in a horizontal plane about the midpoint of the straight portion of the plate's periphery. Two vertical, telescopic, spring loaded poles attached to the upper track cooperate with two base blocks attached to the lower plate to hold the device in a vertical plane between floor and ceiling.

3 Claims, 4 Drawing Figures

CLOSET PARTITION — INSTANT CLOSET

SUMMARY OF THE INVENTION

This invention is designed to be used in a corner of a room to convert the corner into a closet. The invention takes the form of a portable doorlike partition with facilities for hanging a large number of garments on hangers.

The partition is flat, when closed. It can be placed at 45° to each wall, in a corner. Attached to the partition is a semi-circular hanger plate that can rotate in a horizontal plane. When the partition is closed, the flat side of the plate is parallel to the partition. When the partition is open, the plate may be rotated to cause the curved portion of the plate to rotate outwardly and thereby allow clothes hung below it to be removed. After use, the plate can be rotated to its original position and the partition closed.

BRIEF DESCRITPION OF THE DRAWINGS

FIG. 1 shows a top view of the invention in use.
FIG. 2 shows a front view of the invention.
FIG. 3 shows a side view of the invention.
FIG. 4 shows the invention with the doors open.

DETAILED DESCRIPTION OF THE PREFERRED EMBODIMENT

Figure 1:
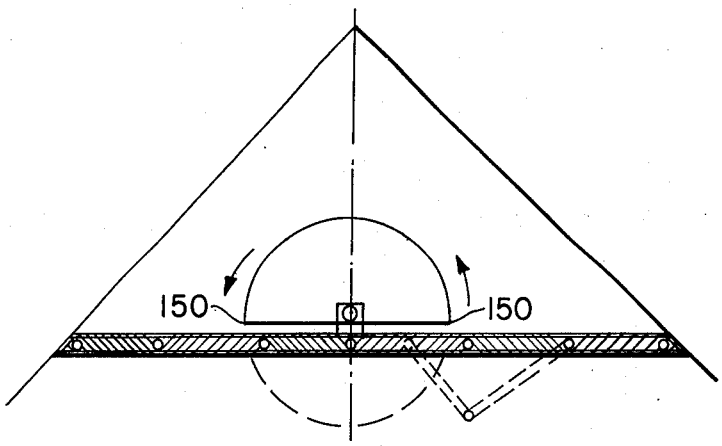

An elongated upper track 10 is directly above a like lower track 20. Between these tracks are two opposed doors generally indicated by 30 and 40. The left most panel of door 30, panel 50, and the rightmost panel of door 40, panel 60, are fixed between the tracks, keeping the tracks properly aligned. Panels 70 in door 30 and panels 80 in door 40 are vertically elongated like panels 50 and 60 and are hingedly attached to each other side-by-side in each door assembly. Thus, panels 70 and 80 can be opened as shown in FIG. 4.

Base blocks 90 are attached to the ends of track 20 to rest upon the floor of the room in which the invention is used. Near each end of track 20 is a vertically elongated, telescopic spring loaded pole 100 that will press against the ceiling of the room in which the device is used. The poles and the blocks will keep the doors aligned vertically in use.

Figure 3:
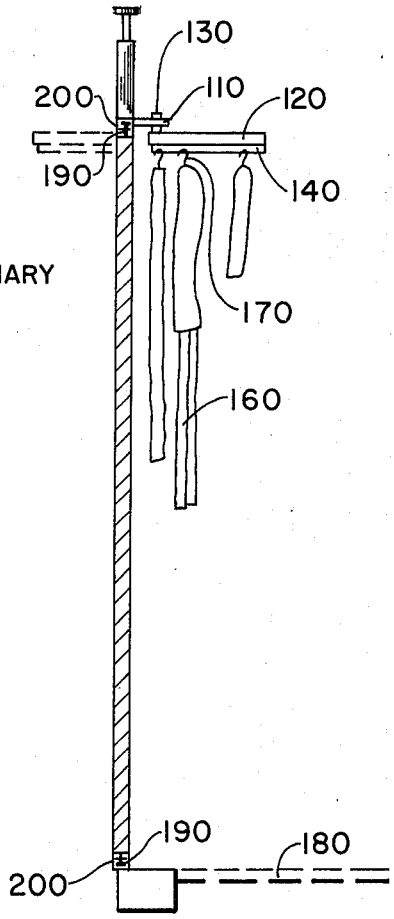

A short flange 110 extends perpendicularly away from the midpoint of track 10. A semi-circular hanger plate 120 is attached to flange 110 by an axle 130. Thus, the plate can be rotated around axle 130, or around the midpoint of the straight portion of its periphery. Below the hanger plate is a rod 140 that is bent into the shape of a semi-circle, and that is attached at its ends to the two corners 150 on the plate. It can be seen in FIG. 3, clothes 160 on hangers 170 can be hung on the rod below the hanger plate. Flat horizontal shelf 180 can be installed on top of blocks 90 if desired.

Figure 4:
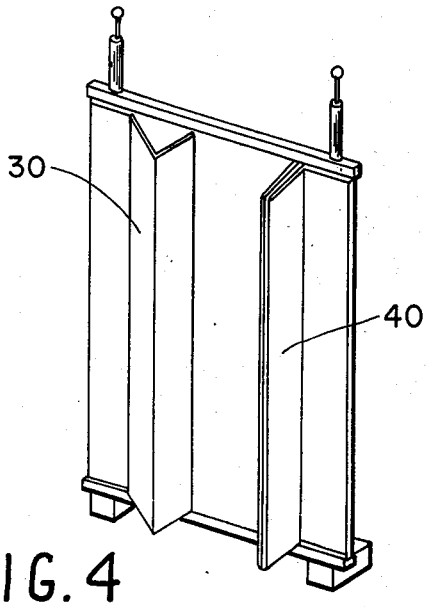
Figure 2:
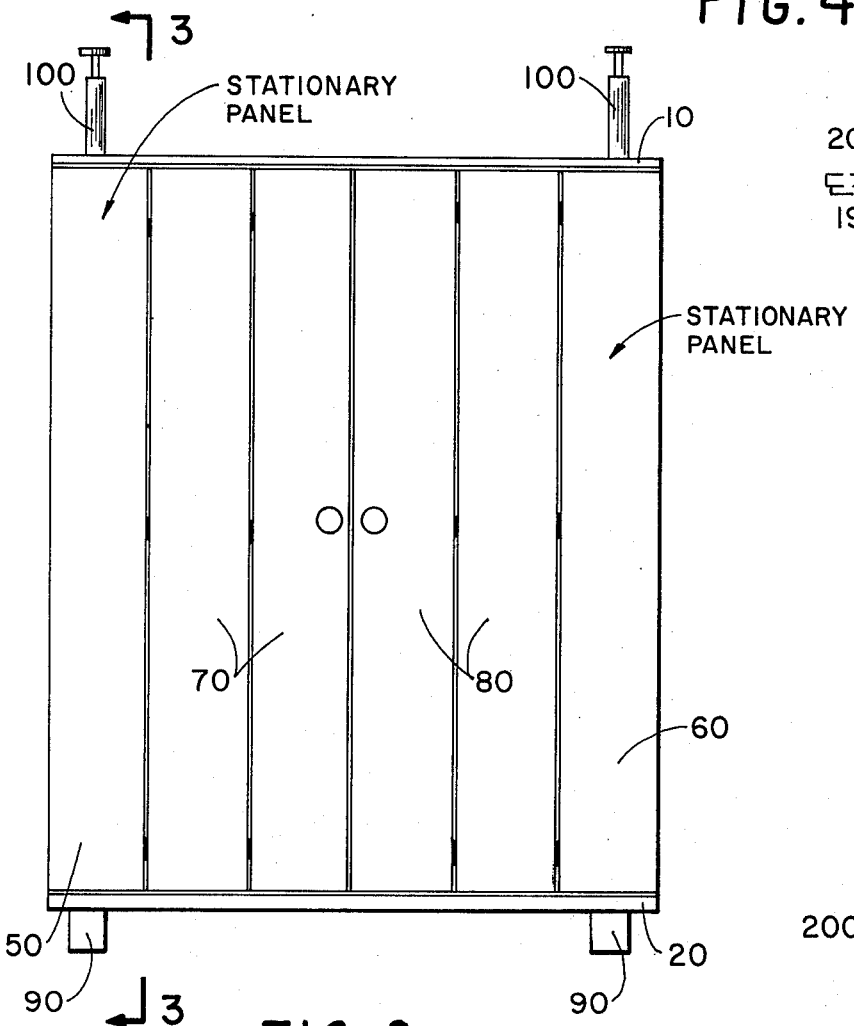

Because the pins 190 at the top and bottom of the free end of each door engage corresponding inner grooves 200 in each track, the doors do not flop open loosely, but fold open neatly as is shown in FIG. 4.

I claim:

1. A closet partition, comprising:
an elongated upper track;
a like elongated lower track;
two like opposed vertical folding panel doors extending between the tracks, each of the doors having a plurality of like vertically elongated panels hingedly secured to each other in side-by-side relationship, with one panel in each door being stationary and fixed at each end to a corresponding track; and
a semi-circular hanger plate pivotally secured to the upper track to be rotatable in a horizontal plane about the midpoint of the straight portion of the periphery of the plate.

2. The device of claim 1 wherein a semi-circular rod is suspended below the hanger plate.

3. The device of claim 2 wherein two like, vertically elongated, spring loaded, telescopic poles are attached to the upper track and wherein two like base blocks are attached to the lower track.

* * * * *